US005409536A

United States Patent [19]

Dimler

[11] Patent Number: 5,409,536

[45] Date of Patent: Apr. 25, 1995

[54] POWDER DISPENSING DEVICE

[76] Inventor: Ernest E. Dimler, 829 Bentwillow Dr., Glen Burnie, Md. 21061

[21] Appl. No.: 153,887

[22] Filed: Nov. 17, 1993

[51] Int. Cl.[6] ..... B05C 11/00

[52] U.S. Cl. ..... 118/264; 222/108; 222/181; 222/189.06; 473/1; 604/289

[58] Field of Search ..... 222/108, 161, 196, 189, 222/565; 118/200, 205, 264, 265, 267, 269; 132/293, 298, 299; 401/200; 273/25, 32 B, 32 D, 32 R; 473/35, 54.1; 604/289, 290, 293

[56] References Cited

U.S. PATENT DOCUMENTS

| | | | |
|---|---|---|---|
| 542,888 | 7/1895 | Harris | 118/264 |
| 609,572 | 8/1898 | Clawson | 222/108 X |
| 1,257,910 | 2/1918 | Meves | 222/181 |
| 1,497,716 | 6/1924 | Fawcett | 222/161 |
| 1,714,281 | 5/1929 | Spring | 222/161 |
| 1,984,651 | 12/1934 | Meves | 222/196 |
| 2,116,300 | 5/1938 | Campos | 222/181 X |
| 2,357,387 | 9/1944 | Dudley | 222/196 X |
| 2,552,817 | 5/1951 | Ross | 222/161 X |
| 2,655,290 | 10/1953 | Mansperger | 222/181 |
| 2,906,578 | 9/1959 | Sessions | 312/242 |
| 2,965,427 | 12/1960 | Sessions | 222/181 X |
| 3,008,609 | 11/1961 | Sessions | 222/181 X |
| 3,059,815 | 10/1962 | Parsons, Jr. | 604/289 X |
| 3,118,428 | 1/1964 | Garvin | 222/165 X |
| 3,193,869 | 7/1965 | Coppock | 401/200 |
| 3,871,558 | 3/1975 | Gournelle | 222/181 |
| 4,429,812 | 2/1984 | Steiner | 222/181 |
| 4,448,560 | 5/1984 | Monaco, Jr. | 401/200 |
| 4,878,602 | 11/1989 | Weigelt | 222/181 X |

FOREIGN PATENT DOCUMENTS

| | | | |
|---|---|---|---|
| 701671 | 1/1931 | France | 132/298 |

*Primary Examiner*—Kevin P. Shaver
*Attorney, Agent, or Firm*—Charles F. Obrecht, Jr.

[57] ABSTRACT

A powder dispensing device for dispensing powder in controlled quantities used in connection with playing billiards is disclosed. The device of the present invention includes a box-type enclosure made of wood or plastic or other suitable material, into which a loose weave cloth container containing powder such as talcum powder is attached to the bottom surface of a substantially semi-circular mounting platform inside the enclosure, closely adjacent to and above an opening in the front of the enclosure. Mounting flanges formed by extending the back of the enclosure beyond the length of the sides of the enclosure allow the entire device to be mounted to a wall or other substantially vertical surface. When the cloth container is agitated, the powder is dispensed directly onto the fingers of a player.

6 Claims, 4 Drawing Sheets

POWDER DISPENSING DEVICE

BACKGROUND OF THE INVENTION

1. Field of the Invention

The invention relates to a new powder dispenser for dispensing powder in controllable quantities used in connection with playing billiards.

2. Related Art

It is generally known by persons who participate in playing billiards, that a player's hands must be dry in order to allow a pool stick or cue to slide freely between, through, or on the player's fingers during the preparation of the aim for the shot, the shot itself, and to allow a smooth follow-through.

Often a player's hands become moist with perspiration causing a cue to stick to the player's fingers rendering play difficult. To remedy this problem, players apply powder to the fingers which support the end of the cue which comes in contact with a cue ball.

Powder dispensers of various kinds are in wide use by both professional and amateur players, at private residences, and at commercial billiard establishments. These dispensers range from the shaker dispenser type as shown in the Sussman U.S. Pat. No. Des. 278,121 issued Mar. 26, 1985, and the Bushberger Utility U.S. Pat. No. 3,963,237 issued on Jun. 11, 1976, to canister types which dispense powder upon pushing a spring valve similar to liquid soap dispensers, to loose weave cone shaped cloth containers mounted on an open spindle attached to a platform mounted on a wall.

The shaker dispenser requires two hands to twist or remove a cap to allow the powder to be dispensed, and then they have to be shaken with one hand to apply powder to the fingers of the other. In these instances, the player must put the pool stick down, or otherwise hold it so as to free up both hands. The resulting inconvenience and loss of concentration is manifest. In addition, a substantial amount of the powder will miss the fingers of the hand and end up on the floor as waste.

The soap dispenser type and the loose weave cone cloth containers on spindles herein mentioned, while requiring the use of only one hand to apply the powder, nevertheless result in substantial amounts of powder which ends up as waste on floors which have to be cleaned frequently. The open loose weave cloth containers on open spindles are also subject to misuse which causes quick deterioration of the containers, and are easily stolen.

SUMMARY AND OBJECTS OF THE INVENTION

In view of the above described problems, it is an object of the present invention to provide a new type of powder dispensing device which is simple in its design, and varied in its application for use by billiard players in different environments, and is easy to refill.

It is a further object of this invention, to provide a powder dispensing device through the use of a box-type enclosure mounted on a substantially vertical surface, and having affixed therein, a durable loose weave cloth container enclosing an amount of powder which will be dispensed on the fingers of a player upon being agitated by tapping the container. In this way, the powder dispensed from the container is applied directly to the fingers resulting in the minimal waste which is generated being nevertheless retained in the enclosure. The excess powder which may be dispensed, falls to the bottom of the enclosure instead of on the floor.

The above objects of this invention are accomplished with a box-type enclosure made of wood or plastic or other suitable material, into which the loose weave cloth container containing powder, such as talcum powder, is attached to the lower surface of a substantially semi-circular mounting platform inside of the enclosure, closely adjacent to and above an opening in the front of the enclosure. Mounting flanges formed by extending the back of the enclosure beyond the length of the sides of the enclosure allow the entire device to be mounted to a wall or other substantially vertical surface.

The enclosure can be assembled with a hinged front to allow easy access to the inside in order to replace the cloth container and the front could be locked with the use of a simple latch and key assembly or through the use of a padlock or other locking device to allow easy access for changing the container on the one hand, and to prevent theft of the cloth containers, on the other.

DETAILED DESCRIPTION OF THE PREFERRED EMBODIMENT

Figure 1:
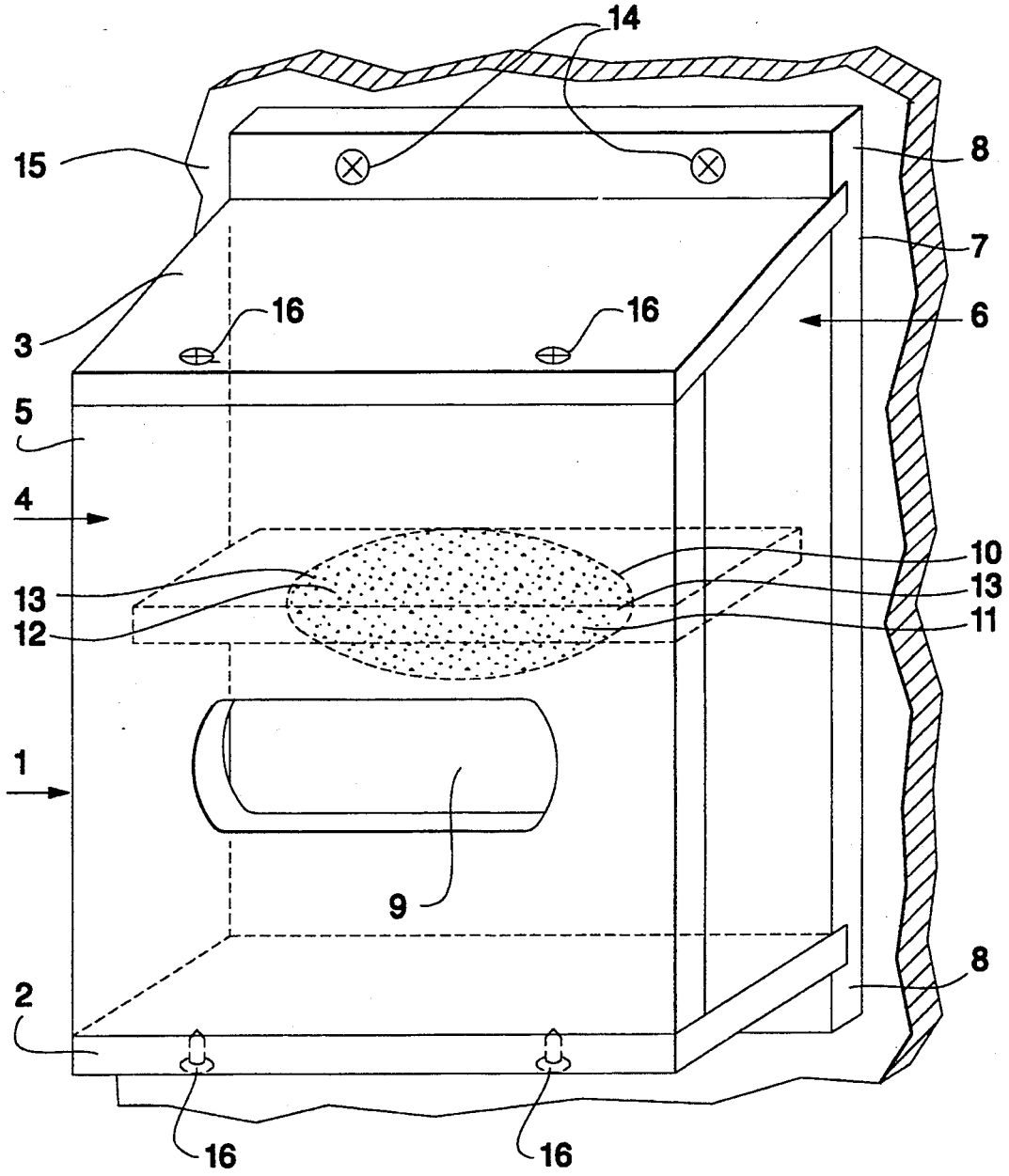
FIG. 1 is a perspective view of the preferred embodiment of the powder dispensing device of the present invention.

Figure one shows the enclosure generally designated by the number 1. Referring to FIG. 1, the enclosure 1 may be formed as a box-like structure made of wood, plastic or other suitable material. It has a rectangular vertical elongated backwall 7, bottom and top walls 2 and 3 respectively, a front wall 4 and upright side walls 5 and 6, all of which are flat and meet at substantially right angle corners. The front wall 4 of the enclosure contains on opening 9 of sufficient size to allow a human hand to pass through.

The back wall 7 extends downwardly and upwardly past the bottom wall 2 and the top wall 3, respectively, to form flanges 8 to attach the enclosure on wall 15 with attaching means 14.

The front wall 4 is formed with an opening 9, substantially midway between the bottom and top walls 2 and 3 respectively, said opening being formed of sufficient size so as to allow a human hand to enter therethrough and reach the cloth container. The bottom and top walls 2 and 3 respectively are removably fastened to the front wall 4 by fastening means 16 to allow access to the inside of the enclosure 1.

Inside the enclosure 1, and immediately above the opening 9, a substantially semi-circular mounting platform 10 is fixedly attached to the front wall 4 in a position coplanar to the bottom wall 3. A loose weave cloth container 11, containing powder 12, is demountably mounted to the lower surface of the mounting platform 10 by mounting means 13, within easy reach by the fingers of a human hand inserted into the opening 9. The cloth container 11 allows the powder 12 to escape from the container when agitated.

The powder 12 is easily and controllably dispersed onto the fingers, when the cloth container 11 is tapped or agitated by the finger striking said container one or more times as needed.

Figure 2:
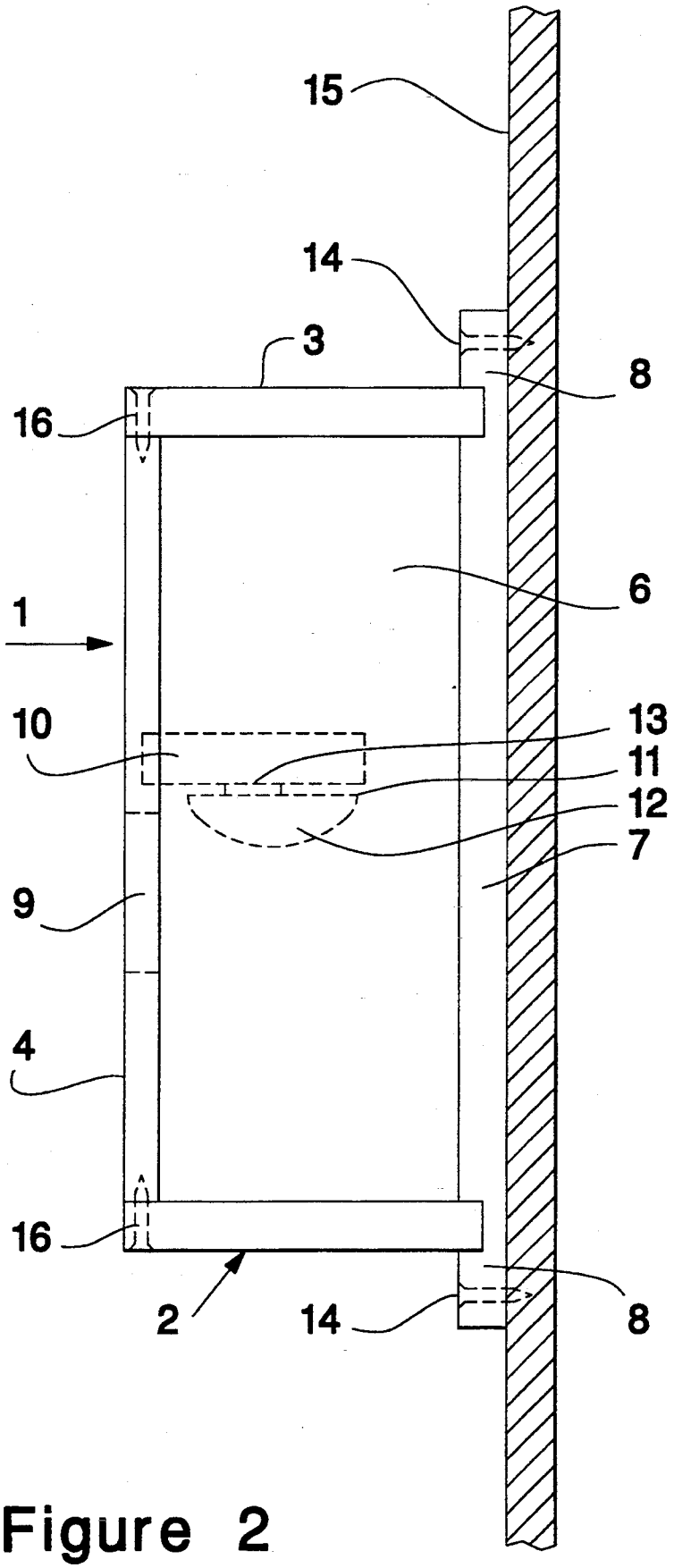
FIG. 2 is a detailed front view of the preferred embodiment of the invention showing the opening into which the player's hand is inserted to reach the loose weave cloth container.

FIG. 2 shows the position of the cloth container 11 and powder 12, relative to the opening 9. It is apparent that the shape of the opening could be oblong, as shown, or circular, or any other suitable shape large enough to accommodate the fingers of a human hand but small enough to prevent the powder from escaping from the enclosure 1.

Figure 3:
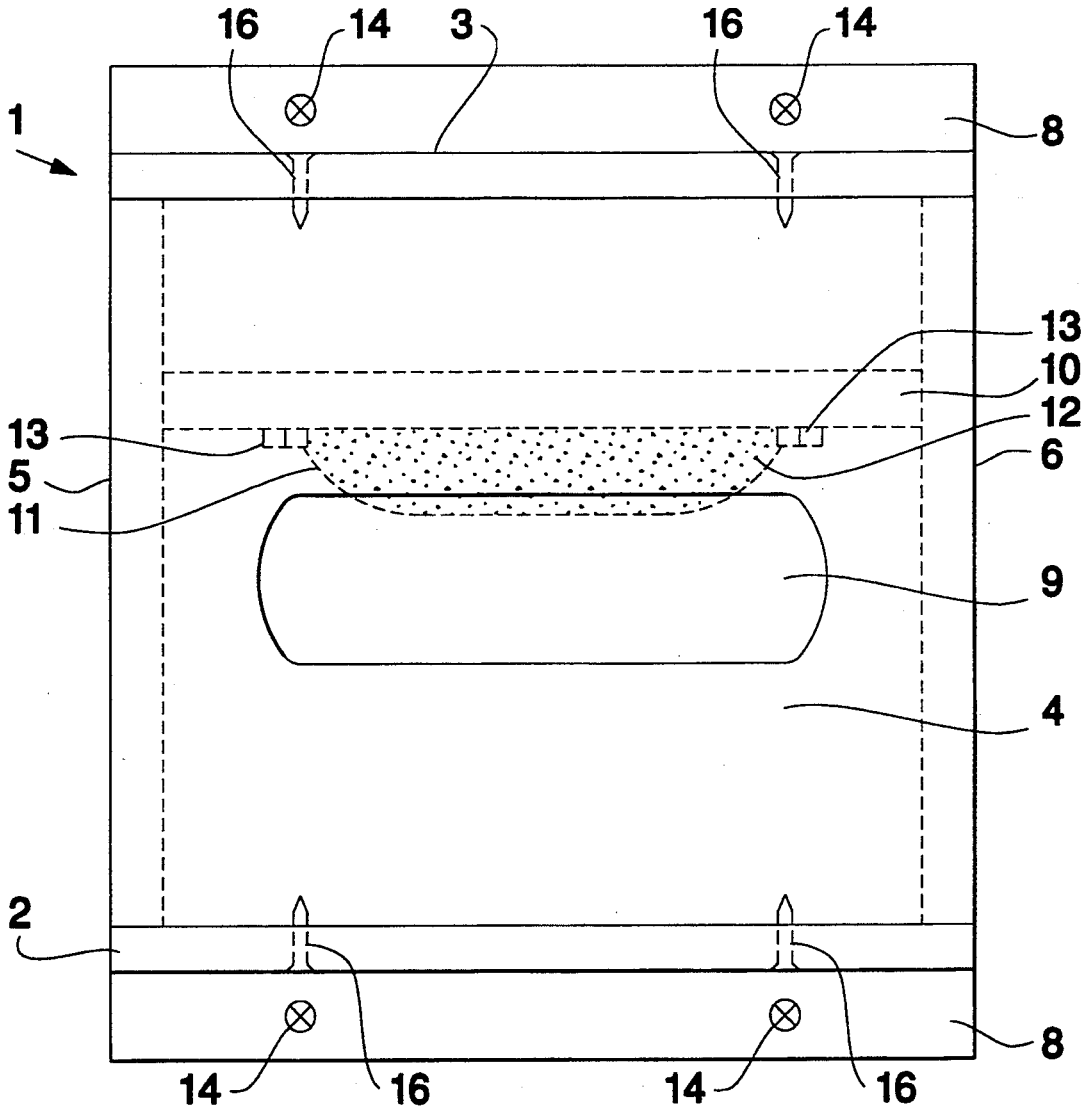
FIG. 3 is a detailed side view of the preferred embodiment of the invention mounted on a wall, showing the relative positions of the lower surface of the mounting platform which is attached to the front wall, and the attached cloth container, to the opening in the front of the enclosure.

FIG. 3 shows the cloth container 11 and powder 12 relative to the front and back walls 4 and 7 respectively. This figure also shows the invention mounted on a substantially vertical wall 15 by fastening means 14 inserted through flanges 8.

It is now apparent that while the invention is in use, a player simply inserts the fingers of one hand through the opening 9 and strikes the cloth container 11 thus agitating the powder 12 and allowing the said powder 12, to pass through the cloth container 11 and onto the fingers of the player in such quantities as are directly proportional to the number of strikes and the magnitude of the force of such strikes.

Figure 4:
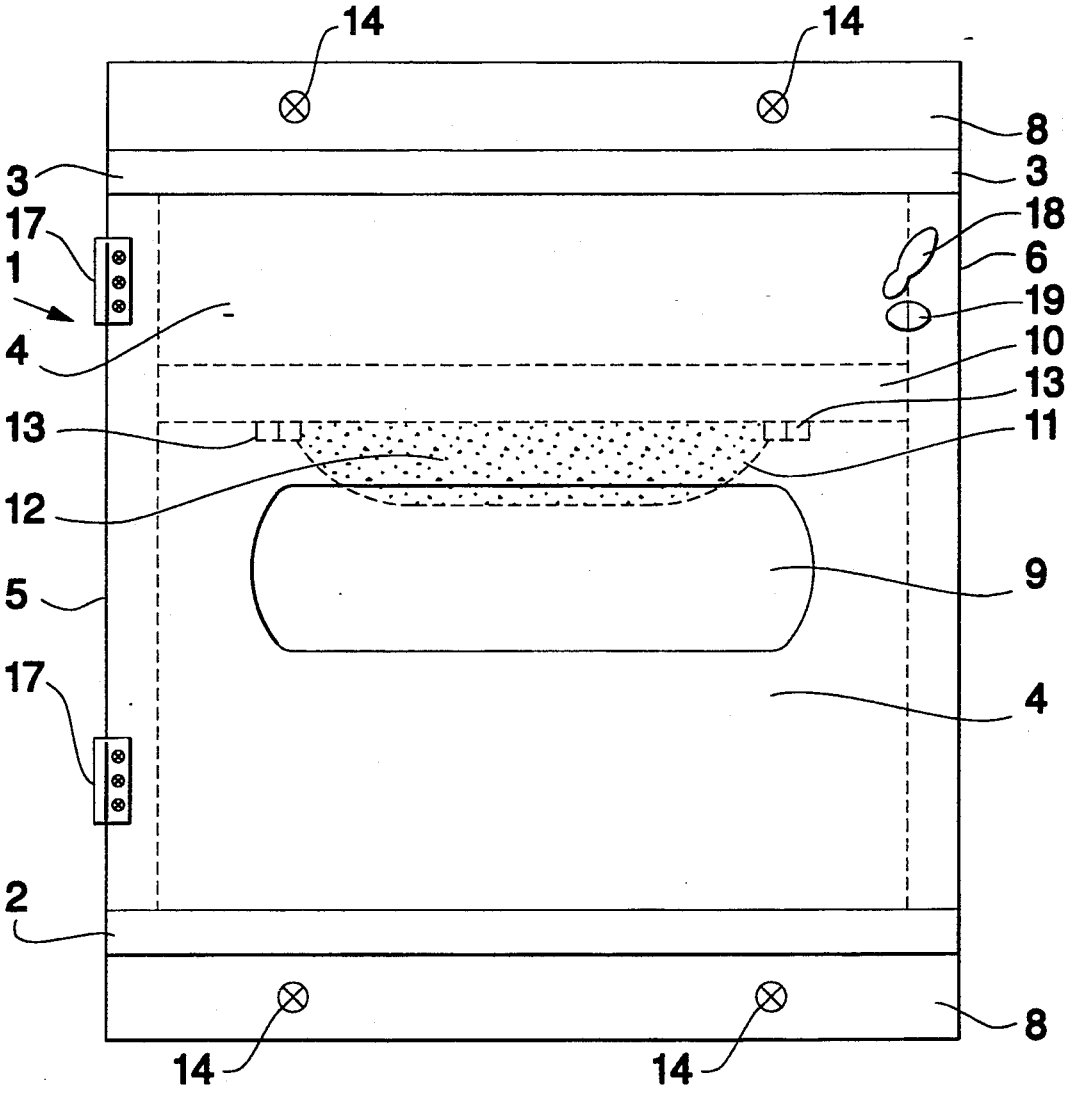
FIG. 4 is a front view of one embodiment of the invention showing the front wall of the enclosure hinged on one side and latched and locked on the other.

Another embodiment of the invention is shown in FIG. 4 where the front wall 4 is hingedly connected to the side wall 5 by hinges 17, and removably attached to the side wall 6 by latching means 18 and/or locking means 19, thus allowing easy access to the inside of the enclosure to replace the cloth container 11 after all the powder is used.

While two embodiments of the invention have been described, it will be understood that it is capable of further modification, and this application is intended to offer any variations uses or adaptions of the invention, following, in general, the principles of the invention and including such departures from the present disclosures as to come within the knowledge as customary practice in the art to which this invention pertains and as may be applied to the essential features hereinbefore set forth and falling within the scope of the invention or the limits of the appended claims.

I claim:

1. A powder dispensing device for controllably dispensing powder such as talcum powder, onto the fingers of a person, comprising:

(a) an enclosure having a front wall with an opening, a back wall, a pair of opposite side walls, and a top and bottom wall that have front edges near a plane that contains the front edges of the front wall;

(b) a mounting platform attached to the inside of the front wall; and (c) a powder container made of a loose weave cloth, demountably attached to the lower surface of said mounting platform at a position which is adjacently above the opening in the front wall.

2. The powder dispensing device as in claim 1 wherein the front wall is removably attached to the top and bottom walls by fastening means.

3. The powder dispensing device as in claim 1 wherein the front wall is hingedly attached to one side wall and attached to the opposite side wall by detachable latching means.

4. The powder dispensing device as in claim 1 wherein the front wall is hingedly attached to one side wall and attached to the opposite side wall by detachable latching means and locking means.

5. The powder dispensing device as in claim 3 wherein the mounting platform is of a substantially semi-circular shape.

6. The powder dispensing device as in claim 4 wherein the mounting platform is of a substantially semi-circular shape.

* * * * *